United States Patent [19]

Kakuhashi et al.

[11] Patent Number: 4,495,524

[45] Date of Patent: Jan. 22, 1985

[54] PART FOR A SLIDE VARIABLE RESISTOR

[75] Inventors: Takeshi Kakuhashi; Hiroshi Tahara, both of Osaka, Japan

[73] Assignee: Nitto Electric Industrial Co., Ltd., Osaka, Japan

[21] Appl. No.: 506,267

[22] Filed: Jun. 21, 1983

[51] Int. Cl.[3] ..... H01C 1/012

[52] U.S. Cl. ..... 338/314; 338/115; 338/125; 338/176; 338/309; 338/328; 29/829; 252/513

[58] Field of Search ..... 338/115, 125, 126, 307, 338/176, 308, 309, 314, 327, 328, 330, 332, 225, 295; 252/513, 514, 518; 75/170, 175 R; 29/829

[56] References Cited

U.S. PATENT DOCUMENTS 3,684,998 8/1972 Zablocki ..... 338/174
4,204,187 5/1980 Kakuhashi et al. ..... 338/314 X
4,220,945 9/1980 Kakuhashi et al. ..... 338/308
4,243,969 1/1981 Steigerwald et al. ..... 338/309
4,345,236 8/1982 Eichelberger et al. ..... 338/176

FOREIGN PATENT DOCUMENTS 2726134 12/1978 Fed. Rep. of Germany ..... 338/314

*Primary Examiner*—Volodymyr Y. Mayewsky
*Attorney, Agent, or Firm*—Sughrue, Mion, Zinn, Macpeak, and Seas

[57] ABSTRACT

A part for a slide variable resistor provided on an insulated support thereof with a film resistive layer adapted for a slide terminal to be slid along the surface thereof, which part is characterized in that said film resistive layer comprises a main resistive layer pattern bound to the insulated support and a protective resistive layer pattern coated on said main resistive layer pattern, wherein the protective resistive layer pattern has a larger sheet resistivity than said main resistive layer pattern.

4 Claims, 5 Drawing Figures

PART FOR A SLIDE VARIABLE RESISTOR

FIELD OF THE INVENTION

The present invention relates to a part for a slide variable resistor which has a slide member adapted to be slid along the surface of a resistor pattern on an insulated support of the resistor.

BACKGROUND OF THE INVENTION

The so-called thin film resistor, which has a metal thin film resistive layer formed on an insulated support, wherein the layer is formed by vacuum deposition, cathode sputtering, or plating, provides a better properties than known metalglazed resistor or printed resistor in terms of temperature coefficient of resistance, sliding noise, and load life. However, the thin film resistor has a very short slide life and hence it has limited utility in a slide variable resistor.

The substrate-type thin film resistor, which is obtained by subjecting to a subtractive method treatment (i.e. mask etching method), a three-layer printed circuit board having a metal thin film resistive layer deposited, for example, by plating on one side of a copper foil, and has an insulated support superposed thereon, is disclosed in U.S. Pat. No. 4,220,945. This resistor is better in terms of temperature coefficient of resistance, uniformity of resistance, and other similar properties. Further, this resistor has advantages such as being light in weight, it is free of cracking and chipping, and its production cost is low. Nevertheless, the metal thin film resistive layer in this resistor is very vulnerable to mechanical friction. Hence, the resistance value offered by the resistor is readily increased as the sliding member is slid on the surface of the metal thin film resistive layer.

Furthermore, this resistive layer, without a cover coat of insulating resin, is deficient in other properties such as resistance to moisture, resistance to heat, and resistance to soldering. Thus, the substrate type thin film resistor is not useful as a resisting member in a slide variable resistor.

A resistor having a multiplicity of gold-plated electrodes arranged in the pattern of teeth of a comb on a metal thin film resistive layer pattern and having a slide member adapted to be slid along the array of electrodes has also been used. However, this resistor is not suitable when fine adjustments of the resistance value are required since the variation in the resistance value effected by the movement of the sliding member occurs stepwise and not continuously.

Furthermore, this resistor has a disadvantage in that it requires incorporation of an electrode portion adapted for the sliding member to be slid thereon and, consequently, necessitates a proportionate addition to the overall width of the resistor.

In addition, electrodes having the pattern of teeth of a comb are disadvantageous since the gold plate deposited on the electrodes is gradually abraded and scraped off in the form of fine particles as the number of movements of the sliding member thereon increases. Eventually, this results in the individual electrodes being short-circuited.

SUMMARY OF THE INVENTION

The present invention is aimed at eliminating the aforementioned disadvantages of conventional resistors. Specifically, the present invention relates to a part for a slide variable resistor provided on an insulated support thereof with a film resistive layer pattern adapted for a slide terminal to be slid along the surface thereof, which part is characterized in that the film resistive layer pattern on the insulated support comprises a main resistive layer pattern bound to the insulated support and a protective resistive layer pattern superposed on the main resistive layer pattern, wherein the protective resistive layer pattern has a larger sheet resistivity than the main resistive layer pattern.

DETAILED DESCRIPTION OF THE INVENTION

In the present invention, the film resistive layer pattern has a multi-layer structure and the overall sheet resistivity obtained by the film resistive layer pattern is the sum of the sheet resistivity of the main resistive layer pattern and the protective resistive layer pattern. Since the sheet resistivity of the main resistive layer pattern is smaller than that of the resistivity of the protective resistive layer pattern, it dominates the overall resistance value of the film resistive layer pattern. Moreover, the main resistive layer pattern is covered by the protective resistive layer pattern. Thus, the main resistive layer pattern is protected against external forces such as the sliding motion.

The metal thin film resistor described above, which exhibits outstanding performance in terms of, for example, temperature coefficient of resistance, may be advantageously used when modified in the manner of the main resistive layer pattern.

Figure 1:
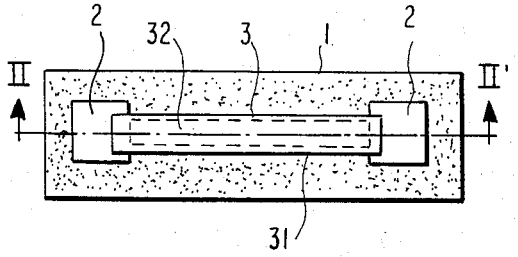
FIG. 1 is a plane view of a preferred embodiment of the present invention.
Figure 2:
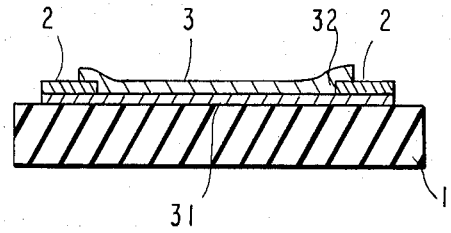
FIG. 2 is a cross-section taken along the line II—II' in FIG. 1.

FIG. 1 is a plane view of a preferred embodiment of the present invention and FIG. 2 is a cross section taken along the line II—II' in FIG. 1. In FIG. 1 and FIG. 2, 1 is an insulated support, 2 is a copper electrode, and 3 is a film resistive layer pattern. Film resistive layer pattern 3 consists of a main resistive layer pattern 31 and a protective resistive layer pattern 32.

During the service of the resistor, a sliding member (not shown) is slid along the surface of the protective resistive layer pattern 32. This sliding member is electrically connected to the main resistive layer pattern 31 through the medium of the protective resistive layer pattern 32. Since the protective resistive layer pattern 32 has an extremely small thickness, the resistance in the direction of the thickness is negligible.

Figure 3:
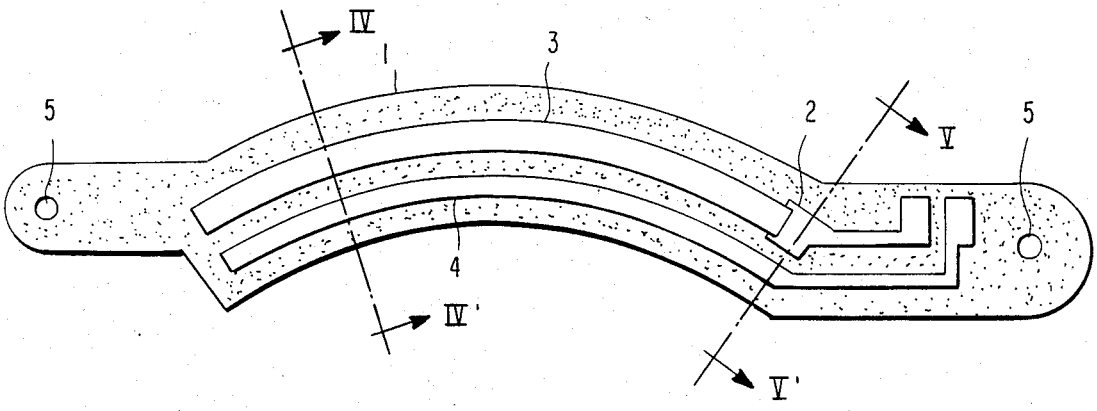
FIG. 3 is a plane view of another preferred embodiment of the present invention.
Figure 4:
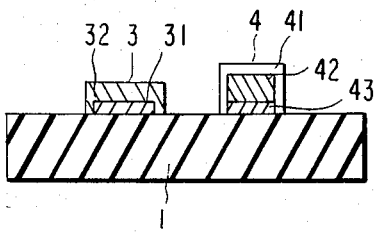
FIG. 4 and FIG. 5 are cross-sections taken along the lines IV—IV' and V—V', respectively, in FIG. 3.
Figure 5:
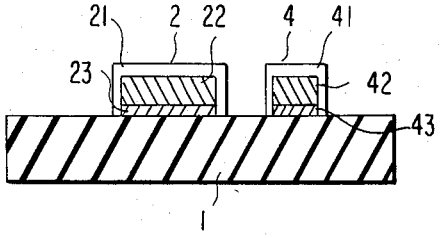

FIG. 3 is a plane view of another preferred embodiment of the present invention, i.e., a slide variable resistor possessing a common sliding electrode. FIG. 4 and FIG. 5 are cross-sections taken along the line IV—IV' and V—V', respectively, in FIG. 3.

In FIG. 3, 1 is an insulated support, 2 is an electrode, 3 is a film resistive layer pattern, 4 is a common sliding electrode, and 5 is a perforation for attachment.

In FIG. 4, 31 is a main resistive layer pattern, 32 is a protective resistive layer pattern, 41 is a gold film, for example, deposited by plating on the surface of the common sliding electrode, 42 is a copper foil pattern, and 43 is a main resistive layer pattern.

In FIG. 5, 21 is a gold film, for example, deposited by plating on the surface of the electrode, 22 is a copper foil pattern, and 23 is a main resistive layer pattern.

The insulated support may be made of, for example, a ceramic sheet, a glass sheet, a glass-epoxy resin laminate sheet, a paper-epoxy resin laminate sheet, or a paper-phenol resin laminate sheet.

The main resistive layer pattern is made of an electrically resistant material having a thickness of 0.01 to 7 μm and a sheet resistivity of 5 ohms per square to 30 kiloohms per square. The main resistive layer may be formed of (1) a metal thin film resistor obtained by electric plating, non-electrolytic plating, cathode sputtering, vacuum deposition, or CVD (chemical vapor deposition); or (2) a cermet resistor obtained by burning a mixture of metal and ceramic.

The protective resistive layer pattern comprises an electrically resistant material having a thickness of 10 to 30 μm and a sheet resistivity of 100 ohms per square to 300 kiloohms per square. Desirably, the protective resistive layer is made using an abrasion-resistant material such as, for example, (1) a paste comprising an electrically conductive powder such as carbon powder, silver powder, or nickel powder and a thermosetting resin such as epoxy resin or polyimide resin; or (2) a paste comprising a noble metal such as gold, silver, or palladium; a base metal such as nickel; and glass frit. The pattern is produced by applying the abrasion-resistant material to a given substrate by printing and curing and baking the applied material.

It is necessary that the sheet resistivity of the protective resistive layer pattern is greater than that of the main resistive layer pattern. Desirably, the former resistivity is 5 to 300 times the latter resistivity.

In the slide variable resistor of the three-layer structure described above, it is particularly desirable to use a metal thin film resistor, particularly one obtained by electroplating, as the main resistive layer pattern 31 and to use a printed resistive layer, obtained by printing a carbon resin paste and thermally curing the applied paste, as the protective resistive layer pattern 32.

The resistance value of the variable resistor of the present invention is the sum of the resistance value of the main resistive layer pattern 31 and the resistance value of the protective resistive layer pattern 32. In a layer pattern combination in which the sheet resistivity of the protective resistive layer pattern is 100 times that of the main resistive layer pattern, the difference between the total resistance value and the resistance value of the main resistive layer pattern is about 1%. Thus, the resistance value of the main resistive layer pattern substantially determines the resistance value of the variable resistor.

Moreover, the various properties of the protective resistive layer pattern such as resistance temperature coefficient of resistance, load life, moisture-proofness, and resistance to thermal shock, negligibly affect the properties of the variable resistor. Thus, the properties of the variable resistor are determined by the properties of the main resistive layer pattern.

Accordingly, proper selection of the materials for the main resistive layer pattern and the protective resistive layer pattern permits manufacture of a part for a slide variable resistor which has desirable resistor properties and offers outstanding resistance to the sliding motion of the sliding member.

The present invention will be described more specifically below with reference to working examples including typical examples of manufacture. However, the examples are in no way meant to limit the present invention.

EXAMPLE 1

One side of copper foil cut to a prescribed size was coated with a masking adhesive sheet (a product of Nitto Electric Industrial Co., Ltd. and marketed under the trademark SPV No. 224: polyvinylchloride sheet having acrylic based pressure sensitive adhesive). This coated copper foil was then immersed in a cleaning solution (a neutral surfactant-type cleaning solution: obtained by diluting Neutra-Clean 68 concentrate, produced by Shipley, with water at a volume ratio of 1:1) and kept at 40° C. for 3 minutes. Then, the coated copper foil was washed with water. Next, the coated copper foil was immersed in a 20% aqueous hydrochloric acid solution for 3 minutes, washed with deionized water, and treated in a plating bath consisting of 19.0 g/liter of $SnCl_2.2H_2O$, 30.0 g/liter of $NiCl_2.6H_2O$, 200 g/liter of $K_4P_2O_7.3H_2O$, 20 g/liter of nitroethane, 10 g/liter of ammonium citrate, and a small amount of a 28% aqueous ammonia solution for pH adjustment (pH 8.2 at 25° C.) at 50° C., 0.1 A/dm$^2$ current density, using a nickel plate as the anode, 20 seconds of plating time, and no stirring of the bath. A resistor layer having a thickness of 0.02 μm on one side of the copper foil is thereby deposited by electroplating. The deposited resistive layer of Sn-Ni alloy was found to have a sheet resistivity of 100 ohms per square.

Next, a glass cloth impregnated with epoxy resin was superposed on the resistive layer and treated in a lamination press under application of heat and pressure, to produce an insulated support. In this manner, a printed circuit substrate incorporating a resistive layer was obtained.

The substrate obtained as described above was coated on the copper foil side thereof with a film-type photoresist (for example, a product of DuPont marketed under the trademark Liston 16S) and exposed and developed by conventional methods to expose only the portion of the copper foil which corresponded to the copper electrode 2 illustrated in FIG. 1. The exposed surface of the copper foil was then plated with solder to a thickness of about 5 μm. Then, the photoresist was peeled off by conventional methods. Next, the entire surface of the copper foil was coated with the photoresist and exposed and developed to allow only the portion of the photoresist corresponding to the film resistive layer pattern 3 of FIG. 1 to remain intact and the remaining portion of the photoresist to be etched out.

The surface of the copper foil thus treated was then treated with an ammonia-type copper etching solution (a product of Yamatoya Shokai marketed under the trademark "Alkali Etch") to etch out the corresponding portion of the copper foil. Next, the resistive layer exposed by this etching treatment was treated with an etching solution consisting of 12.5 moles/liter of phosphoric acid, $4\times10^3$ moles/liter of cupric phosphate; the balance being water, at 85° C. for 10 minutes to etch out the insulated support.

Then, the photoresist still remaining on the substrate was peeled off and the copper foil on the resistive pattern was removed by etching as described above. During this etching treatment, the electrode portion of the copper foil was protected against the etching by the coat of solder applied by plating in advance. In the resistive layer thus formed between the copper electrodes 2 (which layer corresponds to the main resistive layer pattern 31 in the present invention), the resistance value between the two electrodes was 20 kiloohms.

Finally, on the exposed resistive layer between the copper electrodes 2, carbon resin paste (for example, a product of Method Development Corp. marketed under the trademark "LTR 2103": a graphite-epoxy resin paste) was deposited by printing through the medium of a screen mask of 200 mesh and then was cured at 163° C. for 2.5 hours to produce a 20 μm thick protective resistive layer pattern.

The same protective resistive layer alone in a separate test run showed a sheet resistivity of 10,000 ohms per square, whereas the variable resistor obtained as described above shows a resistance value of 19.9 kiloohms per square between the two electrodes.

Subsequently, a multi-contact type sliding member having a total contact pressure of 35 gr. was slid on the resistor 100,000 times continuously (with one complete reciprocating motion constituting one time) at a speed of 2,000 slides/hour. The resistance value between the two electrodes was measured before and after the sliding test. A comparison of the resistance value thus obtained showed that the resistance value after the test was 3.2% higher than that before the test.

In a comparative experiment, the procedures described above were repeated to produce a substrate on which a resistive pattern of the same shape was deposited but the substrate had an exposed main resistive layer pattern due to the omission of the above-described printing of carbon paste. The resulting resistor was subjected to the sliding test described above. In this case, the resistance value rose to about five times the initial value after the sliding member was slid thereon 50 times continuously (90 seconds) at the rate of 200 slides/hour.

The resistor of the present example obtained in accordance with the present invention; the resistor which was not coated with the protective resistive layer as described above (comparative resistor 1); and a printed resistor obtained by printing and curing the carbon paste used as a coating agent (comparative resistor 2) were tested for temperature coefficient of resistance, resistance to high temperatures, resistance to high moisture, resistance to moisture under load, and resistance to thermal shock in addition to the sliding property mentioned above. The results are shown in Table 1.

TABLE 1

| Item of test | Conditions of test | Resistor of this invention | Comparative resistor 1 | Comparative resistor 2 |
|---|---|---|---|---|
| Temperature coefficient of resistance | Temperature range: −55° C. to +155° C. | +50 PPM/°C. | +50 PPM/°C. | +450 PPM/°C. |
| Sliding property* | Multi-contact type sliding member (having total contact pressure of 35 gr) slid at a rate of 2,000 slides/hour | +3.2% 100,000 times | +500% 50 times | +2.7% 100,000 times |
| Resistance to high temperature* | Standing at 100° C. in normal atmosphere for 240 hours under no load | +0.5% | +2.3% | +7.4% |
| Resistance to high moisture* | Standing at 85° C. and 85% R.H. for 500 hours under no load | +1.2% | +14.3% | +10.7% |
| Resistance to moisture under load* | Standing at 40° C. and 90% R.H. for 1000 hours, with 1 W/cm$^2$ of resistor area | +0.3% | +7.5% | +13.4% |
| Resistance to thermal shock* | Exposure to 100 cycles of abrupt temperature change from −55° C. × 30 min. to +125° C. × 30 min. | +0.3% | +1.2% | +15.0% |

*The percentages indicated represent the ratios of change in resistance value before and after the treatment under the indicated conditions.

EXAMPLE 2

On a glass plate 40 mm in length, 15 mm wide, and 0.5 mm thick (product of Corning marketed under the trademark "1723": Lime-Alumina-Silicate), cermet (Cr-SiO) was vacuum deposited. Prior to vacuum deposition, the substrate was thermally treated at 300° C. for 30 minutes for degasification. Vacuum deposition took plate at 1 to $2\times10^{-5}$ Torr and 300° C. After vacuum deposition, the substrate was thermally treated at 300° C. for 60 minutes to achieve a film thickness of 300 Å, and pattern shape of 5 mm×100 mm.

The vacuum deposited film thus obtained showed a sheet resistivity of 300 ohms per square and a resistance value of 6 kiloohms per square between the electrodes.

On the vacuum deposited layer of cermet thus obtained, a thick-layer resistor paste of ruthenium oxide (product of Thermatronics Trading Co., Ltd. marketed under the trademark "Thermalloy 600") was printed through a stainless steel screen of 200 mesh. The printed paste was allowed to level at 20° C. for 20 minutes, then dried at 120° C. for 20 minutes, and baked at 600 to 630° C. for 7 minutes to produce a 20 μm thick protective resistor layer pattern.

The sheet resistivity of the protective resistive layer alone was 8700 ohms per square and the resistance value between the two electrodes of the variable resistor was 5.8 kiloohms per square.

Then the multi-contact sliding member described above, having a total contact pressure of 35 gr., was slid along the resistor 100,000 times continuously at a rate of 2,000 slides/hours. The resistance value of the resistor was measured before and after this sliding test. A comparison of the results of the measurement showed that the resistance value after the test was about 1% higher than that before the test.

In a comparative experiment, a film resistor of the above described cermet (having a sheet resistivity of 300 ohms per square) without a thick layer coat of the above-described paste, was subjected to the above sliding test under the same conditions. After 10,000 slides of the sliding member, the resistance value rose by ratios exceeding 30% in 8 out of 10 test pieces and complete circuit breakage was found in the remaining two test pieces.

With the exception of the sliding property discussed above, the general properties, including the temperature coefficient of resistance were not found to be discernibly affected by the presence or absence of the coat of the thick layer.

While the invention has been described in detail and with reference to specific embodiments thereof, it will be apparent to one skilled in the art that various changes and modifications can be made therein without departing from the spirit and scope thereof.

What is claimed is:

1. A part for a slide variable resistor, adapted for a slide terminal to be slid along the surface thereof, having a film resistive layer comprising a main resistive layer pattern formed by electroplating a thin metal resistor on an insulated support and a protective resistive layer pattern coated on said main resistive layer, wherein said protective resistive layer pattern has a larger sheet resistivity than said main resistive layer pattern, and wherein said protective resistive layer pattern is formed of an abrasion-resistant material selected from the group consisting of (1) a paste comprising (a) an electrically conductive powder selected from the group consisting of a carbon powder, silver powder, and nickel powder; and (b) a thermosetting resin, and (2) a paste comprising (a) a noble metal selected from the group consisting of gold, palladium, and silver, (b) a base metal selected from the group consisting of copper and nickel, and (c) glass frit.

2. A part for a slide variable resistor according to claim 1, wherein said protective resistive layer pattern is formed of an abrasion-resistant material having a thickness of 10 to 30 $\mu$m and a sheet resistivity of 100 ohms per square to 300 kiloohms per square.

3. A part for a slide variable resistor according to claim 1, wherein the sheet resistivity of the protective resistive layer pattern is 5 to 300 times that of the main resistive layer pattern.

4. A part for a slide variable resistor according to claim 1, wherein said main resistive layer pattern comprises a metal thin film resistor wherein said resistor has a thickness of 0.01 to 7 $\mu$m and a sheet resistivity of 5 ohms per square to 30 kiloohms per square.

* * * * *